United States Patent [19]

Suzuki et al.

[11] Patent Number: 4,699,640

[45] Date of Patent: Oct. 13, 1987

[54] CLEAN ROOM HAVING PARTIALLY DIFFERENT DEGREE OF CLEANLINESS

[75] Inventors: Masami Suzuki; Kouki Yamaguchi; Hisato Katayama; Tadayoshi Muta; Masakuni Okubo; Akira Mochizuki; Hiroshi Adachi, all of Tokyo, Japan

[73] Assignee: Kajima Corporation, Tokyo, Japan

[21] Appl. No.: 885,857

[22] Filed: Jul. 14, 1986

[51] Int. Cl.[4] ..... B01D 50/00

[52] U.S. Cl. ..... 55/385 A; 55/472; 55/500; 98/31.6; 98/34.6; 98/36

[58] Field of Search ..... 55/96, 97, 355, 385 A, 55/467, 472, 500; 98/31.5, 31.6, 34.5, 34.6, 36

[56] References Cited

U.S. PATENT DOCUMENTS

| | | | |
|---|---|---|---|
| 4,009,647 | 3/1977 | Howorth | 98/36 |
| 4,094,232 | 6/1978 | Howorth | 98/36 |
| 4,549,472 | 10/1985 | Endo et al. | 98/34.6 |
| 4,608,066 | 8/1986 | Cadwell | 55/385 A |
| 4,632,020 | 12/1986 | Houwer | 98/31.6 |

*Primary Examiner*—Charles Hart

*Attorney, Agent, or Firm*—James H. Tilberry

[57] ABSTRACT

A clean room is adapted to provide a plurality of clean air zones with different degrees of cleanliness. Air is passed through high efficiency particulate air filters in the ceiling of the room and withdrawn through shutters in the floor of the room. The shutters are adjustable to maintain a pressure-balanced system. The room is divided by walls and partitions to define different zones which are filtered by different classes of filters depending on the degree of cleanliness required in each zone.

8 Claims, 3 Drawing Figures

CLEAN ROOM HAVING PARTIALLY DIFFERENT DEGREE OF CLEANLINESS

BACKGROUND OF THE INVENTION

This invention relates to clean rooms of the general type in use in manufacturing operations requiring dust-free and/or aseptic environments. In semiconductor plants, for example, the need has increased for super-clean manufacturing space to facilitate improved manufacturing techniques such as high integration and micro-miniaturization. Further, the need for clean room facilities has increased to facilitate improvements in full automation equipment, automatic transfer machines, unmanned production lines, and the like.

Generally a clean room includes an air laminar flow system in which a high efficiency particulate air filter (HEPA) is installed over the entire ceiling surface of the clean room and an air blower system in which the clean rooms may be classified in terms of the number of airborne particles per cubic foot of air in the room. Thus, Class 100 indicates a high degree of cleanliness; Class 1000 indicates an intermediate degree of cleanliness; and Class 10,000 a lower degree of cleanliness wherein cleanliness is a function of air pressure, velocity, and filtering capacity.

In a prior art Class 100 clean room the entire ceiling may comprise the filtering means. Thus, as shown in FIG. 1, an HEPA filter 1 is mounted across the entire ceiling surface. Air is forced through this filter with uniform speed from a supply chamber 2. The air flows vertically downward into a return chamber 3 from which it is recirculated by means of an air conditioner 4. The system shown in FIG. 1 has several problems:

(i) The intitial installation cost is high because the HEPA filter should be mounted over the entire ceiling surface and a heavy duty air conditioner is needed to achieve complete air flow.

(ii) The operating cost is high because a driven fan is necessary for the air conditioner in order to obtain complete air flow.

(iii) The capacity of the fan must be so great that it becomes a source of vibration.

To solve the foregoing problems, another prior art system has been proposed in which sections needing particular cleanliness are situated in clean areas 5 as shown in FIG. 2.

This system also presents problems:

(i) Fans 6 and duct 7 in the ceiling provide for little flexibility and render maintenance difficult.

(ii) The vibration of the fan is transmitted to the floor.

(iii) The air flow becomes turbulent around the clean area line boundaries.

(iv) The cost and time required for installation are increased because of the need for additional ductwork.

SUMMARY OF THE INVENTION

The present invention overcomes the above-mentioned problems by providing an easily installed system providing a high degree of cleanliness in clean rooms. The present invention also enjoys the advantages of the above-discussed two prior art systems. In addition, the present invention enjoys an advantage not available in the prior art systems. The present system enables a single clean room to have several classes of cleanliness depending on location in the room and need.

The clean room according to the present invention has process zones for semiconductor manufacturing equipment and the like provided by hanging partitions to make a whole surface laminar flow system chamber for a clean room having process sections requiring high degrees of cleanliness, a supply of air from the same flow system chamber and only the most important zones of the clean room having high degrees of cleanliness. The layout may be easily changed by adjustment of the hanging partitions.

OBJECTS OF THE INVENTION

It is therefore among the objects of the invention to provide a clean room by means which: overcome problems inherent in prior art clean room systems; enable shifting of clean zones in a clean room as required; provide means to obtain several specifications of cleanliness within a single clean room; utilize hanging partitions to provide whole surface laminar flow of filtered air; eliminate ducts and fans above the ceiling of a clean room; reduce initial, running, installation, and maintenance costs; employ discreet use of HEPA filters to maximize their effectiveness with the necessary minimum air flow; enable easy control of air flow volume and velocity; and minimize vibration in the system.

These and other objects, features, and advantages of the invention will become apparent in view of the following detailed description of the preferred embodiment shown and described herein and as illustrated in the accompanying drawings in which:

DESCRIPTION OF THE PREFERRED EMBODIMENT

Hereinafter will be described the present invention with reference to an embodiment shown in the accompanying drawings.

Figure 1:
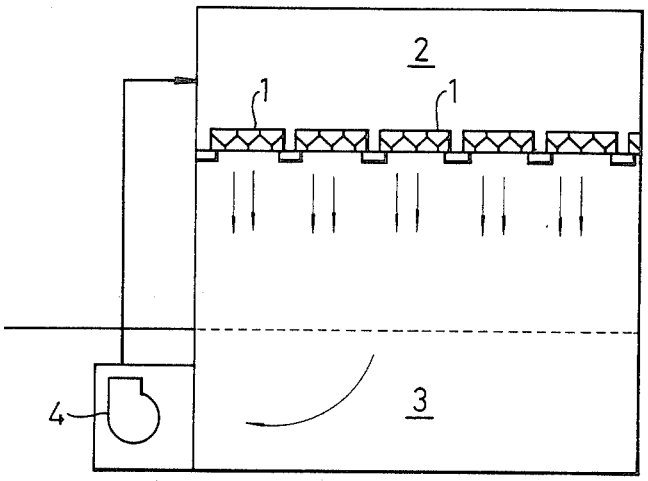
FIG. 1 (PRIOR ART)
FIG. 1 is a schematic sectional view showing a prior whole surface laminar flow system clean room.
Figure 2:
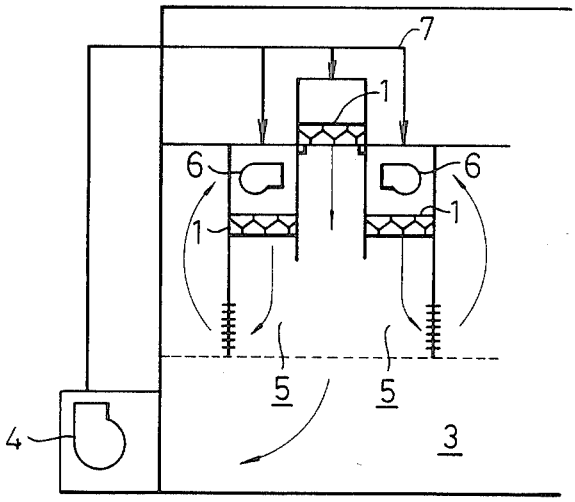
FIG. 2 (PRIOR ART)
FIG. 2 is a schematic sectional view showing a prior free tunnel system clean room.
Figure 3:
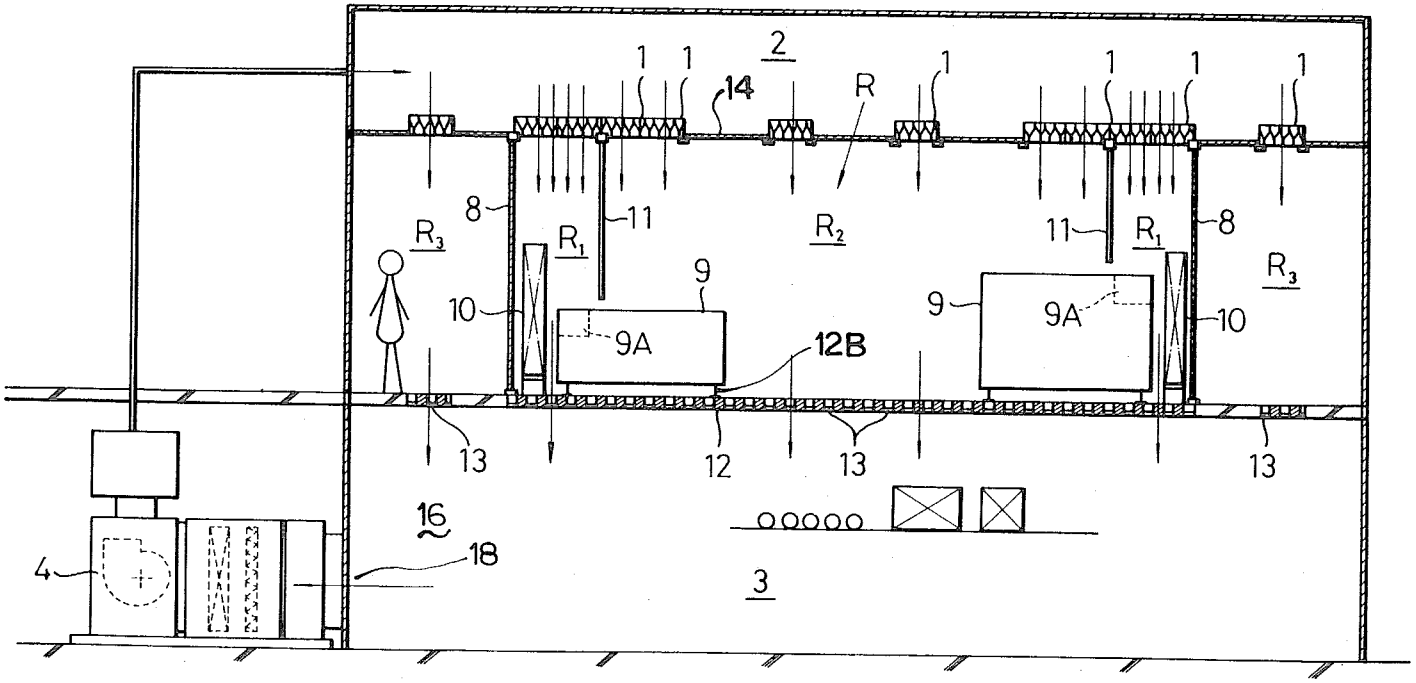
FIG. 3 is a schematic sectional view showing a clean room according to the present invention.

As shown in FIG. 3 the clean room R comprises an unmanned semiconductor manufacturing room having glass partition side walls 8. Semiconductor manufacturing apparatus 9 is installed in the clean room R.

A wafer intake section 9A of the semiconductor manufacturing apparatus 9 and an automatic transfer robot 10 are zones in which the wafer is exposed to room air. The most important zones $R_1$ are partitioned by hanging partitions 11 to provide a whole surface vertical laminar flow system having Class 100 (grain size 0.1 mm) or less of cleanliness.

Zone $R_2$, in which the wafer is not exposed to the room air, is a lesser important zone in which the manufacturing apparatus 9 is placed and accordingly provided with Class 1,000 (grain size 0.3 mm) or less degree of cleanliness.

Outside the manufacturing room R are general purpose zones $R_3$ in which operators work, and these zones are provided with Class 10,000 (grain size 0.5 mm) cleanliness. The respective zones $R_1$, $R_2$, and $R_3$ use the same supply chamber 2 and return chamber 3.

The hanging partitions 11 are antistatic plates of plastic and spaced 20 to 30 mm above the manufacturing apparatus 9. Apparatus 9, in turn, is supported above the floor 12 by suitable pedestal means 12B. A plurality of HEPA filters 1 are positioned in the ceiling 14 adjacent the hanging partitions 11. The degree of cleanliness of each of the zones is defined by regulating the specification, number, and the process air flow (number of times of ventilation per hour) of the installed HEPA filter 1.

SPECIFIC EXAMPLE

Zone $R_1$ (whole surface laminar flow):
480 cycles of ventilation per hour.
(Blast air speed: 0.4 m/s).
Zone $R_2$ (turbulence):
50 cycles of ventilation per hour.
Zone $R_3$ (turbulence):
30 cycles of ventilation per hour.

The uniform pressure in the supply chamber 2 will suffice in order to obtain uniform air pressure and velocity. Since zone 16 of the return chamber 3 near an air conditioner 4 is a low pressure zone, it is sufficient to increase the resistance of egress port 18 near the air conditioner 4 for the return chamber 3 and reduce the resistance of an ingress port remote from the air conditioner 4. For this purpose, a shutter 13 with a filter is provided in an opening of a floor grating 12 to provide necessary resistance for air passing from clean room R to chamber 3.

Relocation of manufacturing apparatus 9 may be made by appropriate change in the number of HEPA filters and relocation of the hanging partitions 11.

As is apparent from the foregoing description, novel means are disclosed which will produce a better quality clean room at lower cost. It will be understood that the above described embodiments of the invention are for the purpose of illustration only. Additional embodiments, modifications and improvements can be readily anticipated by those skilled in the art based on a reading and study of the present disclosure. Such additional embodiments, modifications, and improvements may be fairly presumed to be within the spirit, scope and purview of the invention as defined by the subtended claims.

What is claimed is:

1. A clean room comprising: an upper chamber having a ceiling, side walls, and a floor; an intermediate chamber having side walls and a floor; and a lower chamber having side walls and a floor, the floor member of said upper chamber comprising the ceiling member of said intermediate chamber; the floor member of said intermediate chamber comprising the ceiling member of said lower chamber; an inner chamber within said intermediate chamber having contiguous walls extending between said ceiling and floor of said intermediate chamber to form an enclosure spaced from said side walls of said intermediate chamber; at least one partition suspended from the ceiling of said inner chamber to define a clean zone between said partition and one of said inner chamber side walls; a high efficiency particulate air filter positioned in said ceiling of said inner chamber; a high efficiency particulate air filter of preselected uniform porosity positioned in said ceiling of said clean zone adapted to filter air passing from said upper chamber into said clean zone, the HEPA rating of said clean zone filter being higher than the HEPA rating of the filter otherwise servicing said inner chamber; a filter positioned in said ceiling of said lower chamber adapted to permit a flow of air from said inner chamber to said lower chamber; and means to recirculate air from said lower chamber to said upper chamber.

2. The device of claim 1, including a plurality of partitions suspended from the ceiling of said inner chamber to define a plurality of clean zones between respective partitions and adjacent inner chamber side walls, wherein each clean zone is filtered with an HEPA filter of a different preselected uniform porosity.

3. A clean room comprising exterior walls, interior walls corresponding to and spaced from said exterior walls to define an interior clean air room; a ceiling; a floor; an enclosed air space above said clean room; an enclosed air space below said clean room; a first partition suspended from said ceiling to define a first clean air zone between said first partition and one of said interior walls; air filter means in said ceiling and in said floor selected to provide predetermined quality particulate air filtering of different porosities in said interior room and in said first clean air zone; and means to recirculate air from said air space below said clean room to said air space above said clean room.

4. The device of claim 3, including a second partition suspended from said ceiling and spaced from an adjacent interior wall and from said first partition to define a second clean air zone between said first and second partitions, and a third clean air zone between said second partition and said respective adjacent interior wall; and filter means in said ceiling and in said floor selected to provide predetermined quality particulate air filtering of varying porosities in said second and third clean air zones.

5. The device of claim 3 including means to regulate the pressure drop between the filter means in said floor and said means to recirculate air from said air space below said clean room to said air space above said clean room.

6. The device of claim 4 including means to regulate the pressure drop between the filter means in said floor and said means to recirculate air from said air space below said clean room to said air space above said clean room.

7. The device of claim 3 wherein said partitions are composed of antistatic plastic.

8. The device of claim 4 wherein said partitions are composed of antistatic plastic.

* * * * *